US006106090A

United States Patent [19]

Uchida et al.

[11] Patent Number: 6,106,090

[45] Date of Patent: Aug. 22, 2000

[54] INK JET PRINTING APPARATUS WITH PRINT MEDIUM CONVEYANCE BELT

[75] Inventors: Takashi Uchida; Tomohiro Aoki, both of Yokohama; Yasushi Murayama; Tohru Kobayashi, both of Tokyo; Masatoshi Ikkatai, Kawasaki; Tatsuo Mitomi, Yokohama; Masaharu Nemura, Yokohama; Yasuyuki Takanaka, Yokohama, all of Japan

[73] Assignee: Canon Kabushiki Kaisha, Tokyo, Japan

[21] Appl. No.: 08/931,524

[22] Filed: Sep. 16, 1997

Related U.S. Application Data

[60] Continuation of application No. 08/506,043, Jul. 24, 1995, abandoned, which is a division of application No. 07/953,021, Sep. 29, 1992, abandoned.

[30] Foreign Application Priority Data

Oct. 2, 1991 [JP] Japan ..... 3-255190

[51] Int. Cl.[7] ..... B41J 25/308

[52] U.S. Cl. ..... 347/8; 347/16; 347/104

[58] Field of Search ..... 347/8, 16, 42, 347/43, 104; 400/55, 56, 57, 48; 271/193; 399/301, 371, 372, 394, 395

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,660,077 | 4/1987 | Kawamura et al. | 355/327 X |
| 4,662,739 | 5/1987 | Sakai et al. | 355/327 |
| 4,723,129 | 2/1988 | Endo et al. | 346/1.1 |
| 4,740,796 | 4/1988 | Endo et al. | 346/1.1 |
| 5,055,861 | 10/1991 | Murayama et al. | 346/140 R |
| 5,121,170 | 6/1992 | Bannai et al. | 271/193 |
| 5,136,307 | 8/1992 | Uchida et al. | 346/136 |

FOREIGN PATENT DOCUMENTS

| | | | |
|---|---|---|---|
| 0376345 | 7/1990 | European Pat. Off. . | |
| 0381197 | 8/1990 | European Pat. Off. . | |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 62-051530 | 3/1987 | Japan . | |
| 63-75779 | 4/1988 | Japan | 355/212 |
| 3-211138 | 9/1991 | Japan . | |

*Primary Examiner*—John Barlow
*Assistant Examiner*—Craig A. Hallacher
*Attorney, Agent, or Firm*—Fitzpatrick, Cella, Harper & Scinto

[57] ABSTRACT

A recording apparatus builds an image at high quality without occurrence of malfunctions attributable to raised/recessed spots on the surface of a conveyance belt and insufficient dimensioning for the width of the conveyance belt, while preventing the interior of the recording apparatus from being contaminated with erroneously ejected ink. The recording apparatus includes a conveyance belt for conveying a recording sheet below four kinds of recording heads, and the conveyance belt has a joint line along which the opposite ends of a band-shaped material are joined to each other. In addition, the conveyance belt has a band-shaped colored portion which is located remote from the joint line by a predetermined distance. The colored portion is detected by an optical sensor, and a control unit controls the driving of the conveyance belt in response to a signal derived from the detection of the optical sensor.

30 Claims, 7 Drawing Sheets

INK JET PRINTING APPARATUS WITH PRINT MEDIUM CONVEYANCE BELT

This application is a continuation of application Ser. No. 08/506,043, filed Jul. 24, 1995, now abandoned, which, in turn, is a division of application Ser. No. 07/953,021, filed Sep. 29, 1992, now abandoned.

BACKGROUND OF THE INVENTION

1. Field of the Invention

The present invention relates generally to a recording apparatus. More particularly, the present invention relates to an improvement of a recording apparatus preferably employable not only for a facsimile unit, an electrophotographic copying unit, a printer or the like and a composite unit having functions derived from the foregoing units but also as an output unit for a work station.

2. Description of the Prior Art

Conventionally, recording apparatuses of the foregoing type are classified into two types, one of them being a so-called serial scanning type of recording apparatus including a recording head arranged to achieve recording therewith by scanning and the other one being a so-called full line type of recording apparatus including a recording head fixedly arranged across the maximum width of a recording sheet. Any one of the conventional recording apparatuses as mentioned above is constructed such that a recording medium such as a recording sheet or the like is conveyed by recirculatively driving a conveyance belt so that recording is performed on the recording medium by activating a recording head. The configuration of the surface of the conveyance belt and the width of the same have a significant effect on performances of the recording apparatus as will be described below.

Next, an item "configuration of surface of conveyance belt" and an item "width of conveyance belt" will item-wise be described below as to how the performances of the recording apparatus are affected by these items.

With respect to the item "configuration of surface of conveyance belt":

A recording process of the conventional recording apparatus can be practiced in various manners. In recent years, attention has been paid to a non-impact type recording process in consideration of the fact that noise is generated only to a negligibly small extent during each recording operation. In connection with the non-impact type recording process, it has been confirmed that an ink jet type recording process is very advantageously employable for the recording apparatus because it makes it possible to perform recording at a high speed, and moreover, any particular fixing step is not required for achieving the recording when so-called plain paper is used as a recording medium.

An image recording apparatus having the foregoing ink jet type recording process employed therefor is constructed such that a recording medium such as a paper, a synthetic resin sheet or the like (hereinafter referred to generally as a recording sheet) is conveyed to an image building station by driving, e.g., a conveyance belt so that an image is built on the recording sheet in the image building section. In the case that conveyance of the recording sheet is unstable, there arise malfunctions that the image is elongated or contracted and an optical concentration of the image fluctuates from location to location on the image, resulting in quality of the image being remarkably degraded. For this reason, it is an inevitable subject to be solved for the recording apparatus that the conveyance of the recording sheet is stabilized.

To facilitate understanding of the present invention, a typical, conventional ink jet type image recording apparatus will be described below with reference to FIG. 7.

In FIG. 7, reference numeral 301 designates a scanner section in which an original is optically read and the result derived from the optical reading is converted into an electrical signal. The electrical signal converted in the scanner section 301 is inputted into a recording head portion 305 of a printer section 302 as a drive signal. Recording sheets each serving as a recording medium are received in a sheet feeding portion 303 so that they are delivered toward a belt conveyance portion 304 one by one as desired. As each recording sheet is displaced below the recording head portion 305 by recirculatively driving the belt conveyance portion 304, an image is recorded on the recording sheet by activating the recording head portion 305, and thereafter the recording sheet is delivered to a tray 308 via a fixing/sheet discharging portion 307. In addition, reference numeral 306 designates a restoring cap portion which has a function for maintaining the recording head portion 305 in the operative state so that it is normally ready to perform recording.

A conveyance belt usually employed for the image recording apparatus is made of a band-shaped material such as a synthetic resin such as polyurethane or the like or an elastomeric material such as rubber or the like and prepared in the form of an endless belt of which opposite ends are joined to each other by fusing or a similar process. A certain magnitude of voltage is applied to the surface of the conveyance belt by activating a charger (not shown) to induce an electric charge thereon so that a recording sheet is attracted electrostatically on the conveyance belt and an image is recorded on the recording sheet by activating the recording head portion 305.

When the conveyance belt is prepared in the form of an endless belt in the above-described manner, it is difficult from the technical viewpoint that opposite ends of a band-shaped material are exactly joined to each other, resulting in a line-shaped joint portion (hereinafter referred to as a joint line) formed therebetween being unavoidably slightly recessed and raised at positions along the joint line. Once the recessed/raised spots are formed along the joint line in that way, the recording sheet fails to be reliably placed on the surface of the conveyance belt across the joint line. In addition, the gap between the recording sheet and the recording head varies from location to location along the joint line, resulting in quality of the image being undesirably degraded. Since a thickness of the conveyance belt as measured at the joint line is largely different from that at the other portions of the conveyance belt, when the joint line is positionally aligned with a driving roller as the conveyance belt is recirculatively driven, the speed of the conveyance belt varies, causing the image to be enlarged or contracted. In the case of a colored image, color overlapping or color dislocating occurs.

In the circumstances as mentioned above, in contrast with the foregoing type of conveyance belt made of a band-shaped material of which opposite ends are joined to each other to form a joint line, it has been hitherto required that the conveyance belt is prepared in the form of an endless belt from the beginning. To meet the foregoing requirement, however, it is unavoidable that the endless conveyance belt is made at a very expensive cost.

With respect to the item "width of conveyance belt":

Recording heads employable for the aforementioned ink jet type recording apparatus are classified into two types, one of them being a serial scanning type of recording head and the other one being a full line type of recording head. As far as a width of the conveyance belt is technically concerned, the full line type recording head is particularly advantageously employable for the recording apparatus.

Specifically, in the case that the serial scanning type recording head is employed for the recording apparatus, it is easy to perform recording only within the range defined by the width of a recording sheet by detecting the foremost end of the recording sheet as a carriage moves. In addition, the size or area of a blank space on the recording sheet can adequately be adjusted by properly controlling an interval from the time when the foremost end of the recording sheet is detected until the time when a recording operation is started. On the other hand, in the case that the full line type recording head including a number of nozzles in the transverse director is employed for the recording apparatus, it is fixedly mounted on the recording apparatus. Thus, if a recording sheet fails to be correctly aligned with the nozzles during a conveying operation, there arises a malfunction that characters or images are erroneously recorded at the positions located away from the foremost end of the recording sheet. At the same time, the size or area of a blank space on the recording sheet varies. When ink is ejected from all the nozzles of the serial scanning type recording head because of some trouble, there is no possibility that the interior of the recording apparatus is contaminated with the extra ink ejected from the nozzles because no ink is ejected therefrom at the position where the recording head moves beyond a home position. On the contrary, in the case that the full line type recording head including a number of nozzles in the transverse direction is employed for the recording apparatus, ink is ejected from all the nozzles at all the positions, causing the extra ink ejected therefrom to flow outside of the recording sheet and the conveyance belt. Thus, the interior of the recording apparatus is noticeably contaminated with the ink.

Any particular consideration has not hitherto been taken with respect to the relationship among a width of the conveyance belt, a length of the recording head including a number of nozzles in the transverse direction and a width of the recording sheet. Therefore, no satisfactory measure has been taken to obviate the malfunction that ink is erroneously ejected from the recording head, resulting in the interior of the recording apparatus being contaminated with the ejected ink.

With respect to the aforementioned conventional recording apparatus, it is very difficult from the technical viewpoint that the conveyance belt is made in the form of an endless belt from the beginning using a molding die so as to meet the requirement for making uniform the thickness of the conveyance belt along the full length of the latter. This leads to a problem that the conveyance belt is made at an expensive cost.

Another problem is that the interior of the recording apparatus is contaminated with extra ink when the ink is erroneously ejected from the recording head and then flows outside of the width of the conveyance belt.

SUMMARY OF THE INVENTION

The present invention has been made in consideration of the aforementioned background.

An object of the present invention is to provide a recording apparatus which assures that the problems inherent to the conventional recording apparatus arising attributable to factors associated not only with the configuration of a surface of a conveyance belt but also with the width of the same are completely eliminated.

According to a first aspect of the present invention, there is provided a recording apparatus for performing recording on a recording medium, wherein the recording apparatus comprises an endless conveyance belt for conveying the recording medium in the longitudinal direction of the recording apparatus, the conveyance belt having a transversely extending joint line along which opposite ends of a band-shaped material are joined to each other; a length of the conveyance belt as measured in the direction of conveyance being dimensioned to be longer than a length of each recording medium; at least one recording head for achieving the recording on the recording medium by ejected ink; detecting means for detecting the position of the joint line on the conveyance belt; and controlling means for controlling the driving of the conveyance belt based on the detection result from the detecting means.

In addition, according to a second aspect of the present invention, there is provided a recording apparatus for performing recording on a recording medium wherein the recording medium having a predetermined width $L_P$ is conveyed by a conveyance belt having a predetermined width $L_B$ and recording is achieved by at least one recording head having a predetermined practically available recording length $L_H$ as measured in the transverse direction of the conveyance belt; wherein a relationship represented by the following inequality is established among the predetermined width $L_B$, the predetermined width $L_P$ and the predetermined length $L_H$;

$$L_B > L_H > L_P$$

wherein the conveyance belt is arranged such that the recording medium is located inside of the conveyance belt as seen in the transverse direction; and wherein the recording head is arranged such that it is located inside of the recording medium as seen in the transverse direction.

With the recording apparatus of the present invention constructed in the above-described manner, a control unit controls the driving of the conveyance belt in response to a signal generated when the position of the joint line on the conveyance belt is detected by an optical sensor. Since the width of the conveyance belt is set to a predetermined one based on the relationship of a practically available recording width of the recording head relative to the width of each recording medium, there do not arise not only a malfunction attributable to the configuration of the joint line on the conveyance belt but also a malfunction attributable to insufficient dimensioning for the width of the conveyance belt.

Specifically, while a recording medium is placed on the conveyance belt without any interference with the joint line and the conveyance belt is recirculatively driven together with the recording medium, recording is achieved on the recording medium by activating the recording head. Thus, recording can exactly be achieved without occurrence of a malfunction that the recording medium is electrostatically attractively placed across the joint line on the conveyance belt, i.e., a malfunction that recording is achieved with a degraded quality of image not only attributable to incorrect deposition of the recording medium on the conveyance belt but also attributable to variation of a gap between the recording head and the recording medium.

In addition, a relationship represented by the following inequality is established among a width $L_B$ of the conveyance belt, a practically available recording width $L_H$ of the recording head and a maximum width $L_P$ of the recording medium as measured in the direction at a right angle relative to the direction of conveyance $$L_B > L_H > L_P$$

Thus, contamination of the conveyance belt with an extra portion of the ink flowing outside of the recording medium occurs only within the range defined by a portion of the width of the conveyance belt which can easily be cleaned. Consequently, the present invention has provided a recording apparatus which assures that no contamination occurs with the exception of the aforementioned cleanable portion of the conveyance belt.

A series of projections are formed around the periphery of the conveyance belt prepared in the form of an endless belt made of a band-shaped material of which opposite ends are joined to each other to form a joint line. It should be added that the projections are located at positions outside of the practically available recording width of the recording head. Thus, there does not arise a malfunction that the interior of the recording apparatus is undesirably contaminated with an extra portion of the ejected ink. Consequently, an image can be built on the recording paper at a high quality. It should be noted that the present invention should not be limited only to the endless conveyance belt but it may equally be applied to other conveying means rather than the endless conveyance belt.

Additionally, another relationship represented by the following inequality is established among the width $L_B$ of the conveyance belt, a width $L_T$ of a charging roller and the maximum width $L_P$ of the recording medium as measured in the direction at a right angle relative to the direction of conveyance $$L_B > L_T > L_P$$

Since the maximum width $L_P$ of the recording medium is dimensioned to be smaller than the width $L_T$ of the charging roller, and moreover, the width $L_T$ of the charging roller is dimensioned to be smaller than the width $L_B$ of the conveyance belt in the above-described manner, an electric charge can reliably be induced on the conveyance belt with the result that each recording medium can reliably be placed on the conveyance belt and an image can be built on the same at a high quality.

Further, when a width $L_{PL}$ of a platen is dimensioned to be equal to or smaller than the width $L_B$ of the conveyance belt as represented by an inequality of $L_{PL} \geqq L_B$, the recording medium can stably be conveyed by the conveyance belt with small positional offset of the latter in the transverse direction.

Other objects, features and advantages of the present invention will become apparent from reading the following description which has been prepared in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will now be described in detail hereinafter with reference to FIG. 1 to FIG. 6 which illustrate preferred embodiments of the present invention.

First Embodiment

Figure 1:
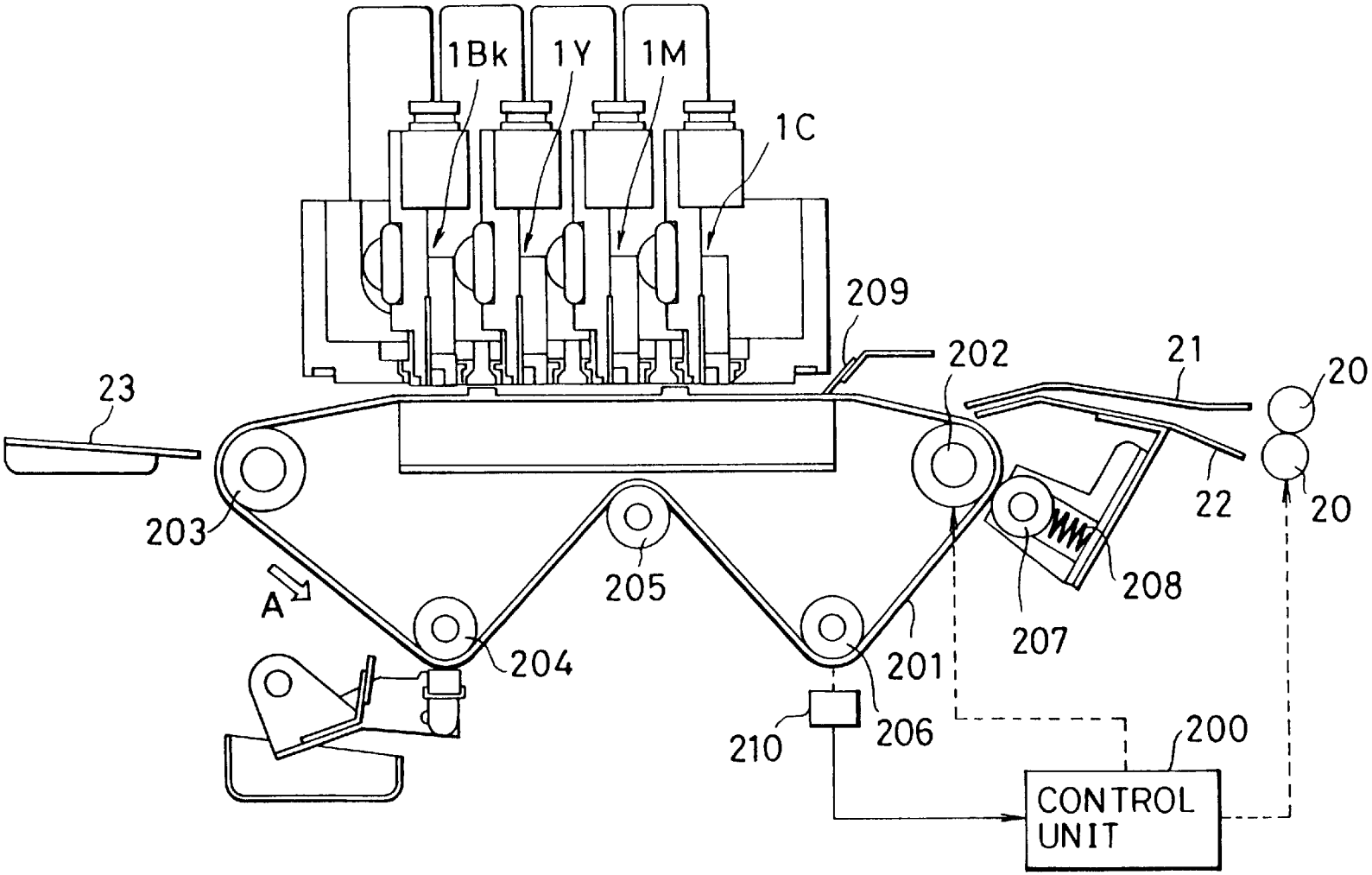
FIG. 1 is a schematic side view of an image recording section in a recording apparatus in accordance with a first embodiment of the present invention.
Figure 2:
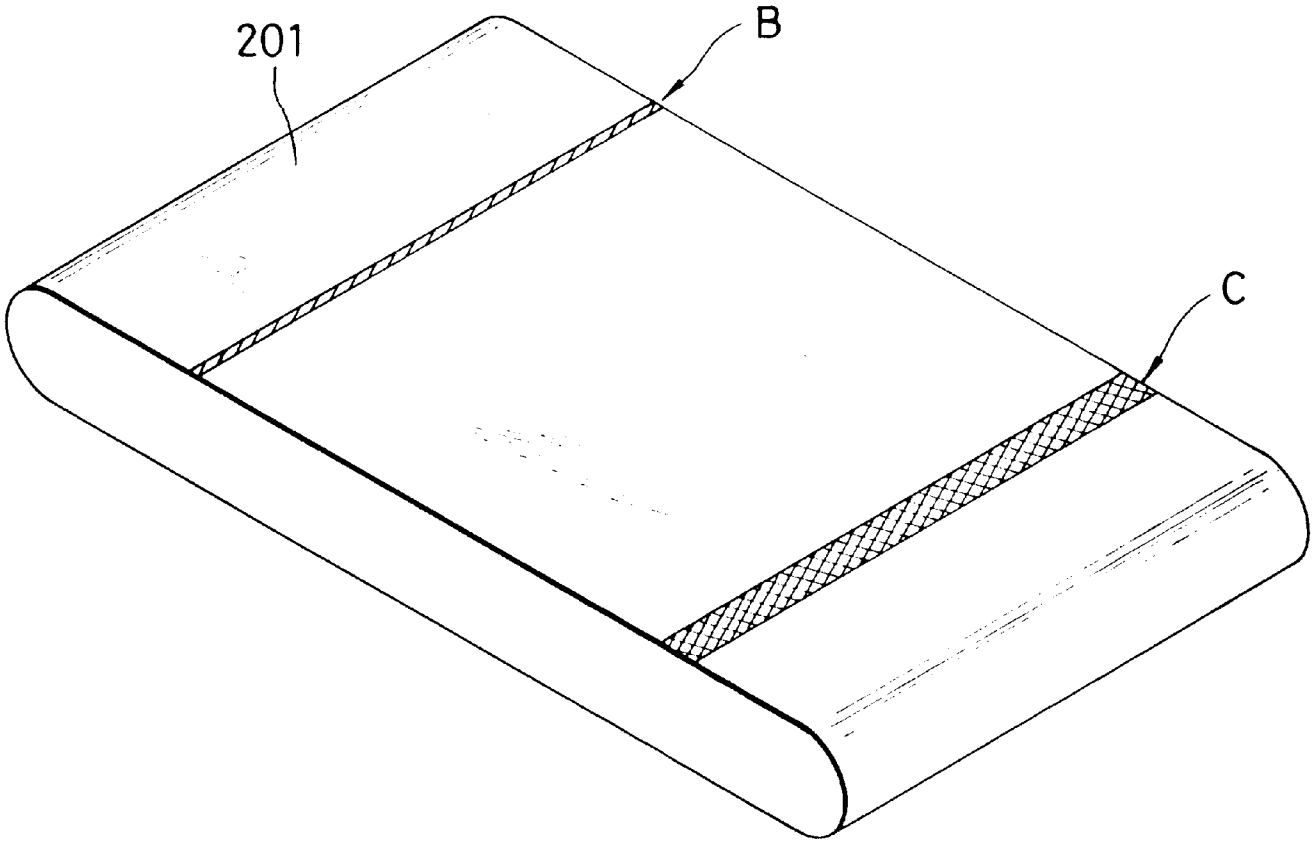
FIG. 2 is a perspective view of a conveyance belt used for the image recording section shown in FIG. 1.

FIG. 1 and FIG. 2 illustrate a first embodiment of the present invention.

Specifically, FIG. 1 is a schematic side view of a recording section in a recording apparatus in accordance with the first embodiment of the present invention. As a recording sheet is delivered from a sheet feeding section, it is conveyed to an image recording section from the right-hand side as seen in FIG. 1. After the recording sheet reaches a pair of resist rollers 20, it is conveyed toward a conveyance belt 201 with the aid of sheet guide plates 21 and 22 while maintaining a proper timing relationship relative to an original scanning unit in a scanner section. The conveyance belt 201 extends around a driving roller 202 to be driven by a motor (not shown) and a plurality of follower rollers 203, 204, 205 and 206. As the driving roller 202 is rotationally driven by the motor in the anticlockwise direction, the conveyance belt 201 is caused to recirculate in the A arrow-marked direction as seen in FIG. 1.

It should be noted that the conveyance belt 201 is molded of an elastomeric material such as rubber or the like or synthetic resin such as polyethylene or the like so that the surface of the conveyance belt 201 serves as an electric insulative substance.

In FIG. 1, reference numeral 207 designates a charging roller. As is apparent from the drawing, the charging roller 207 is arranged such that the conveyance belt 201 is held between the driving roller 202 and the charging roller 207 in the clamped state. The charging roller 207 is brought in pressure contact with the conveyance belt 201 under the effect of the resilient force given by electrode springs 208 disposed at the opposite ends of the charging roller 207, and the electrode springs 208 are electrically connected to a high voltage power source (not shown). When the conveyance belt 201 starts its recirculation after the recording sheet reaches the resist rollers 20, a high voltage having the order of several kV is applied to the conveyance belt 201 from the power source via the electrode springs 208 and the charging roller 202, whereby electric charge is induced over the surface of the conveyance belt 201 so that the recording sheet is electrostatically attractively placed on the conveyance belt 201. In addition, since an electrically conductive depressing member 209 is forced to depress the recording sheet onto the conveyance belt 201 while coming in contact with the latter, the recording sheet is more intensely attractively placed over the conveyance belt 201.

The conveyance belt 201 is prepared in the form of an endless belt by jointing the opposite ends of a band-shaped material to each other, and a length of the conveyance belt 201 as measured around the outer periphery thereof is dimensioned to be longer than the maximum length of a single recording sheet (usually, 420 mm in the case of an A-3 size). It should be noted that a transversely extending joint line B along which the opposite ends of the band-shaped material are joined to each other is slightly raised up on the surface of the conveyance belt 201, as shown in FIG. 2.

At the time before the recording sheet reaches the conveying section, the recirculation of the conveyance belt 201 is stopped so as to allow the joint line B to be normally located at a predetermined position. Specifically, the recirculation of the conveyance belt 201 is properly controlled such that the joint line B is located at the position slightly downstream of the contact position where the foremost end of the recording paper reaches the conveyance belt 201 via the paper guide plates 21 and 22 to come in contact with the same, i.e., the position slightly offset from the contact position in the A arrow-marked direction as seen in FIG. 1. Each controlling operation for properly controlling the position of the joint line B will be described in more detail later. Since the recirculation of the conveyance belt 201 is positionally controlled in the above-described manner, there is no possibility that the recording sheet is electrostatically attractively placed on the joint line B. Consequently, there does not arise a malfunction that the recording sheet is incorrectly electrostatically attractively placed on the conveyance belt 201 when it is located across the joint line B. In addition, a good image can be built on the recording sheet without variation of the gap between recording heads (to be described later) and the recording sheet.

To assure that the recirculation of the conveyance belt 201 is properly controlled in respect of the position of the joint line B, the recording apparatus is equipped with a reflective type optical sensor 210 on the downstream side of the conveyance belt 201. As shown in FIG. 2, a predetermined band-shaped part C on the surface of the conveyance belt 201 is colored with a specific color different from that of the other portion of the conveyance belt 201. When the joint line B on the conveyance belt 201 is located at the position in front of the sheet guide plates 21 and 22 (hereinafter referred to as a home position of the conveyance belt 201), the band-shaped part C is located opposite to the optical sensor 210. At this time, the optical sensor 210 detects, based on the difference between the reflection factor at the band-shaped part C and the reflection factor at the other portions of the conveyance belt 201, that the latter has assumed the home position. The detection signal derived from the detection of the optical sensor 201 is inputted into a control unit 200 which in turn controls not only the time when the conveyance belt 201 is recirculatively driven but also the time when the recording paper is conveyed into the recording apparatus.

While the recording sheet is electrostatically attracted on the conveyance belt 201, it is displaced together with the conveyance belt 201 in the A arrow-marked direction below the recording heads along a platen located opposite to the latter. During the displacement of the recording sheet in that way, the recording heads 1C, 1M, 1Y and 1Bk successively inject four kinds of colored inks, i.e., a cyan colored ink, a magenta colored ink, a yellow colored ink and a black colored ink so as to build a colored image on the recording sheet. After the colored image is recorded on the recording sheet in the above-described manner, the recording sheet is separated away from the conveyance belt 201 at the follower roller 203 and then moves on a guide plate 23 toward a sheet discharging section in the leftward direction as seen in FIG. 1.

Next, description will be made below as to another recording sequence different from the aforementioned one when the size of each recording sheet is changed.

In any case, the length of the outer periphery of the conveyance belt 201 is dimensioned to be longer than the maximum length of a recording sheet to be used. In the shown case, it is dimensioned to be longer than 420 mm, i.e., a length of a largest recording sheet A-3 size, as measured in the longitudinal direction. Thus, all recording sheets each having a size smaller than the A-3 size can electrostatically attractively be placed on the conveyance belt 201 without any interference with the joint line B, whereby the foremost end of each recording sheet can electrostatically attractively be placed on the conveyance belt 201 from the same position above the latter regardless of the sheet size. Also, in the case that recording is successively performed for a plurality of recording sheets, they can electrostatically attractively be placed on the conveyance belt 201 without any interference with the joint line B in the same manner as mentioned above. Next, in the case that recording is performed for recording sheets each having a size smaller than the A-4 size, two or more recording sheets can electrostatically attractively be placed on the conveyance belt 201 without any interference with the joint line B by properly adjusting the time when each recording sheet is conveyed into the recording apparatus. Additionally, in the case that recording is performed for recording sheets each having a size larger than the A-4 size, each recording sheet can be placed on the conveyance belt 201 from the same position directly behind the joint line B with variation of a distance between adjacent two recording sheets by changing the time when the resist rollers 20 are rotationally driven.

Second Embodiment

An ink jet type recording apparatus in accordance with a second embodiment of the present invention will be described below with reference to FIG. 3 and FIG. 4.

Figure 3:
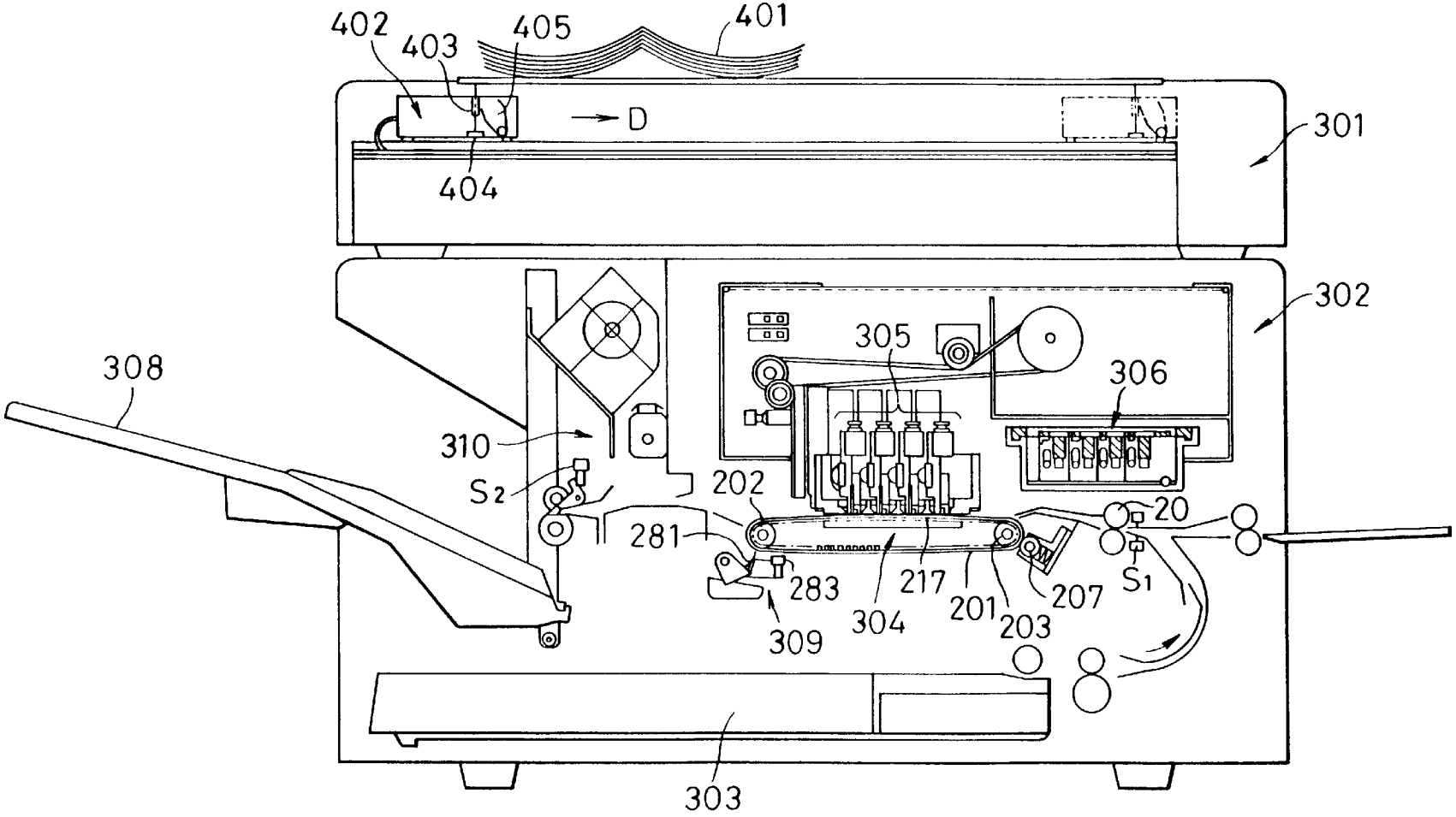
FIG. 3 is a schematic side view of a recording apparatus in accordance with a second embodiment of the present invention.

In FIG. 3, reference numeral 301 designates a scanner section in which an original is optically read and the result derived from the optical reading is converted into an electrical signal. In response to the converted signal, another signal is transmitted from the scanner section 301 to a recording head portion 305 in a printer section 302 as a drive signal. Recording sheets each received in a cassette 303 as a recording medium are delivered toward a belt conveyance portion 304 one by one as desired. The belt conveyance portion 304 includes a conveyance belt 201 which is bridged between a driving roller 202 and a follower roller 203 while extending around them. To assure that the conveyance belt 201 extends with acceptable flatness, a platen 217 is arranged inside of a part of the conveyance belt 201 located opposite to the recording head portion 305. As a recording sheet passes across the belt conveyance portion 304, an image is recorded on the recording sheet by activating a recording head portion 305 and the recording sheet having the image built thereon is then delivered to a tray 308 via a fixing/sheet discharging section 310. In FIG. 3, reference numeral 306 designates a recovering cap section which has a function for maintaining the recording head portion 305 in the operative state such that it is normally ready to perform recording.

In addition, reference numeral 309 designates a cleaner portion for removing ink, contaminant or the like on the surface of the conveyance belt 201. The cleaner portion 309 is composed of a blade 281 for performing a cleaning operation with its edge while holding the conveyance belt 201 between the blade 281 and the driving roller 202 in the clamped state and an absorbing member 283 for absorbing the extra ink on the conveyance belt 201.

Reference numeral 401 designates an original and reference numeral 402 designates an original scanning unit for scanning the surface (lower surface in FIG. 3) of the original 401 in the scanner section 301. The original scanning unit 402 includes a rod array lens 403, a doubling type color decomposing line sensor (color image sensor) 404 and exposing means 405. While the original scanning unit 402 is displaced in the D arrow-marked direction for optically scanning an image on the original 401, an exposing lamp in the exposing means 405 is turned on and the light beam reflected from the original 401 is conducted to the rod array lens 403 and then collected by the doubling type color decomposing line sensor 404 serving as a sensor for reading color image information (hereinafter referred to as a reading sensor). Subsequently, the color image information obtained from the original 401 is separately optically read depending on the kind of each color and they are then converted into electrical digital signals. The digital signals are outputted to the printer section 302. In response to the digital signals, driving signals are transmitted to recording heads allocated to the respective colors so that colored inks are ejected from the respective recording heads.

Figure 4:
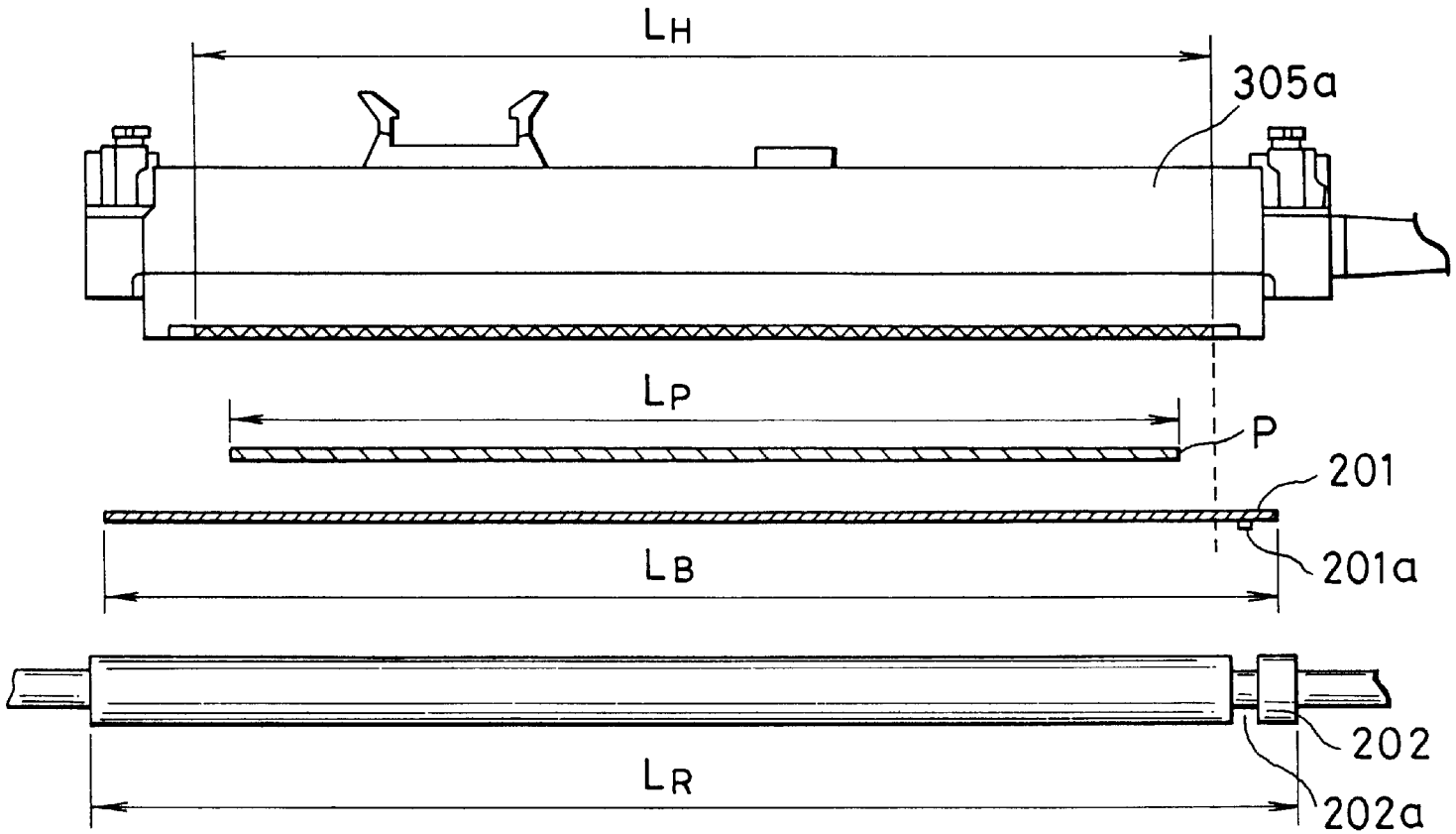
FIG. 4 is a front view of the recording apparatus shown in FIG. 3, particularly illustrating the positional relationship among a recording head, a recording sheet, a conveyance belt and a driving roller.

FIG. 4 is a schematic front view of main components required for building an image as seen from the right-hand side in FIG. 3.

In FIG. 4, reference numeral 305*a* designates a recording head which is arranged in the recording head portion 305 on the most upstream side as seen in the direction of conveyance of each recording sheet. Other recording heads (not shown) are arranged one after another behind the recording head 305*a*. In FIG. 4, reference character P designates a recording sheet.

As is apparent from FIG. 4, the relationship of length $L_R$ of the driving roller 20 relative to width $L_B$ of the conveyance belt 201 is represented by an inequality of $L_R \geqq L_B$. Thus, when the conveyance belt 201 is cleaned by the cleaner portion 309, it can completely be cleaned across the whole width thereof while it is fully held between the blade 281 and the driving roller 202 in the clamped state as seen in the direction of the width thereof.

In addition, the relationship of the width $L_B$ of the conveyance belt 201 relative to a practically available recording width $L_H$ of the recording head 305*a* is represented by an inequality of $L_B > L_H$. Thus, when ink is ejected through all nozzles in the recording head 305*a* for some reason, i.e., when the recording head 305*a* erroneously ejects the ink across the whole range of the practically available recording width $L_H$, a portion of the ink ejected outside of the recording sheet is received by the conveyance belt 201 and the extra ink deposited on the conveyance belt 201 is later removed from the belt in the cleaner portion 309.

Further, the relationship of the practically available recording width $L_H$ of the recording head 305*a* relative to a maximum width $L_P$ of each recording sheet is represented by an inequality of $L_H > L_P$. With the recording apparatus constructed in the above-described manner, the region where an image is built on the recording sheet can properly be controlled by ejecting ink through the selected number of injection nozzles in the recording head 305*a*. However, in the case that an inequality of $L_H \leqq L_P$ is established, the region where an image is built on the recording sheet fails to be satisfactorily adjusted across the whole width of the recording sheet inclusive of blank parts. In this embodiment, in the circumstances as mentioned above, the practically available recording width of the recording head 305*a* represented by $L_H$ is set to 300.7 mm (corresponding to 4736 nozzles each having a resolution of 400 dpi) and the maximum width of the recording sheet represented by $L_P$ is set to 297 mm (corresponding to the shorter length of the A-3 size) so that the foregoing inequality of $L_H > L_P$ is established.

A series of position controlling projections 201*a* are formed around the inner periphery of the conveyance belt 201, and displacement of the projections 201*a* is correctly guided by an annular groove 202*a* on the driving roller 202. There is a possibility that recessed/raised spots are formed at the positions corresponding to the projections 201*a* on the outer surface side of the conveyance belt 201 because of the stress induced when the projections 201*a* are molded. Thus, when recording is performed for a portion of each recording sheet placed on the recessed/raised spots, a recorded image is irregularly built on the recording sheet. In addition, when extra ink is received directly by the conveyance belt 201, cleaning fails to be sufficiently achieved by the cleaning means 307 due to the presence of the recessed/raised spots. For this reason, the projections 201*a* are located outside of the practically available recording width $L_H$ of the recording head 305.

Third Embodiment

Figure 5:
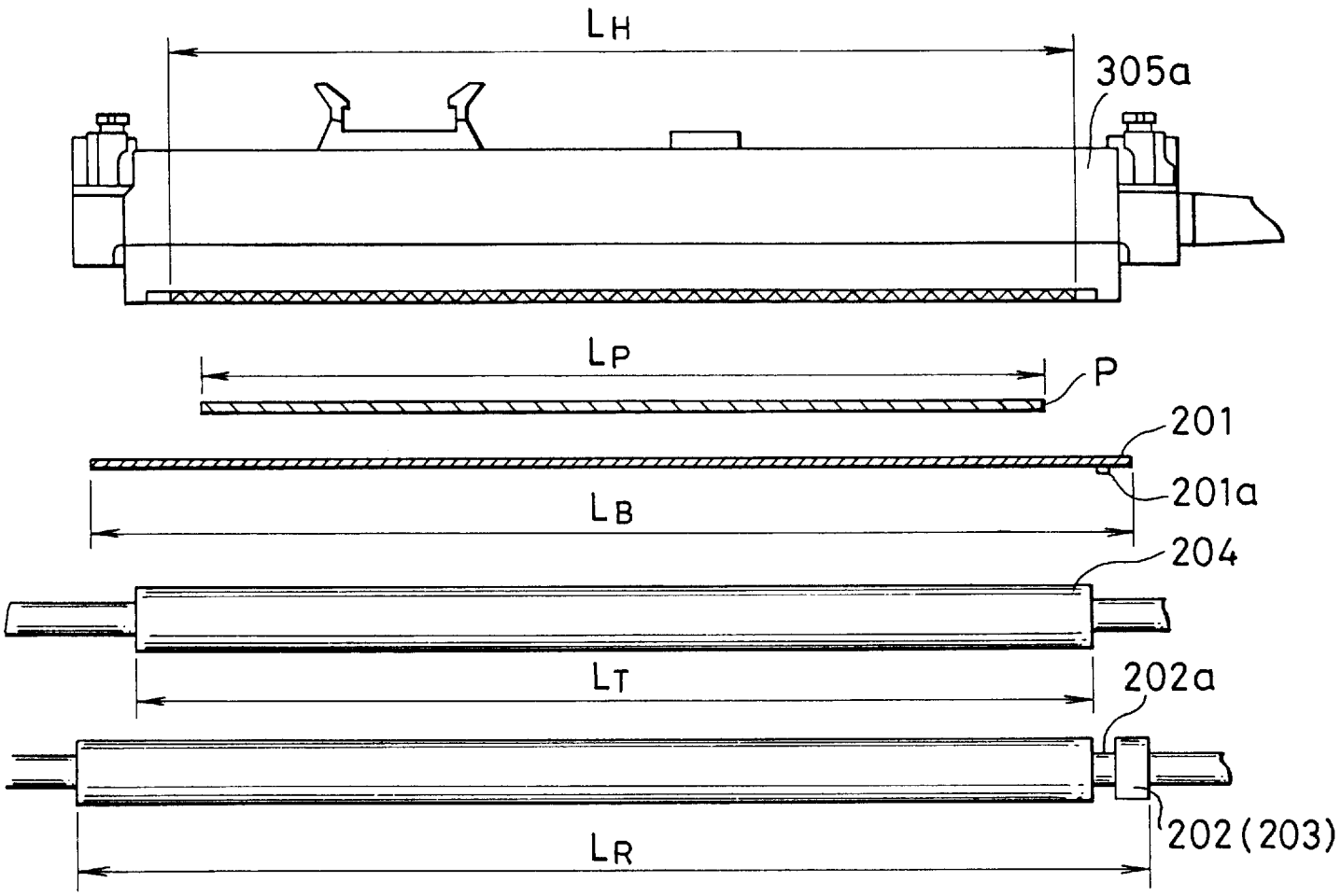
FIG. 5 is a front view of a recording apparatus in accordance with a third embodiment of the present invention, particularly illustrating the positional relationship among a recording head, a recording sheet, a conveyance belt, a driving roller and a charging roller.

A third embodiment of the present invention will be described below with reference to FIG. 5.

In this embodiment, the relationship among length $L_T$ of the charging roller 204, maximum width $L_P$ of each recording sheet and width $L_B$ of the conveyance belt 201 is represented by an inequality of $L_P < L_T < L_B$.

The reason why an inequality of $L_P < L_T$ is established in this embodiment consists in that it is intended that the whole area of the recording sheet is electrostatically attractively placed on the surface of the conveyance belt 201. In addition, the reason why another inequality of $L_T < L_B$ is also established in this embodiment consists in that it is intended that electric charge is reliably induced on the conveyance belt 201 by the charging roller 204 over the full length of the latter. If an inequality of $L_B < L_T$ is established, there is a possibility that an air layer is formed between the charging roller 204 and the follower roller 203, causing an electrical short-circuit to take place due to the ink penetrated into the air gap, whereby no electric charge is induced on the conveyance belt 201 at any location.

Fourth Embodiment

Figure 6:
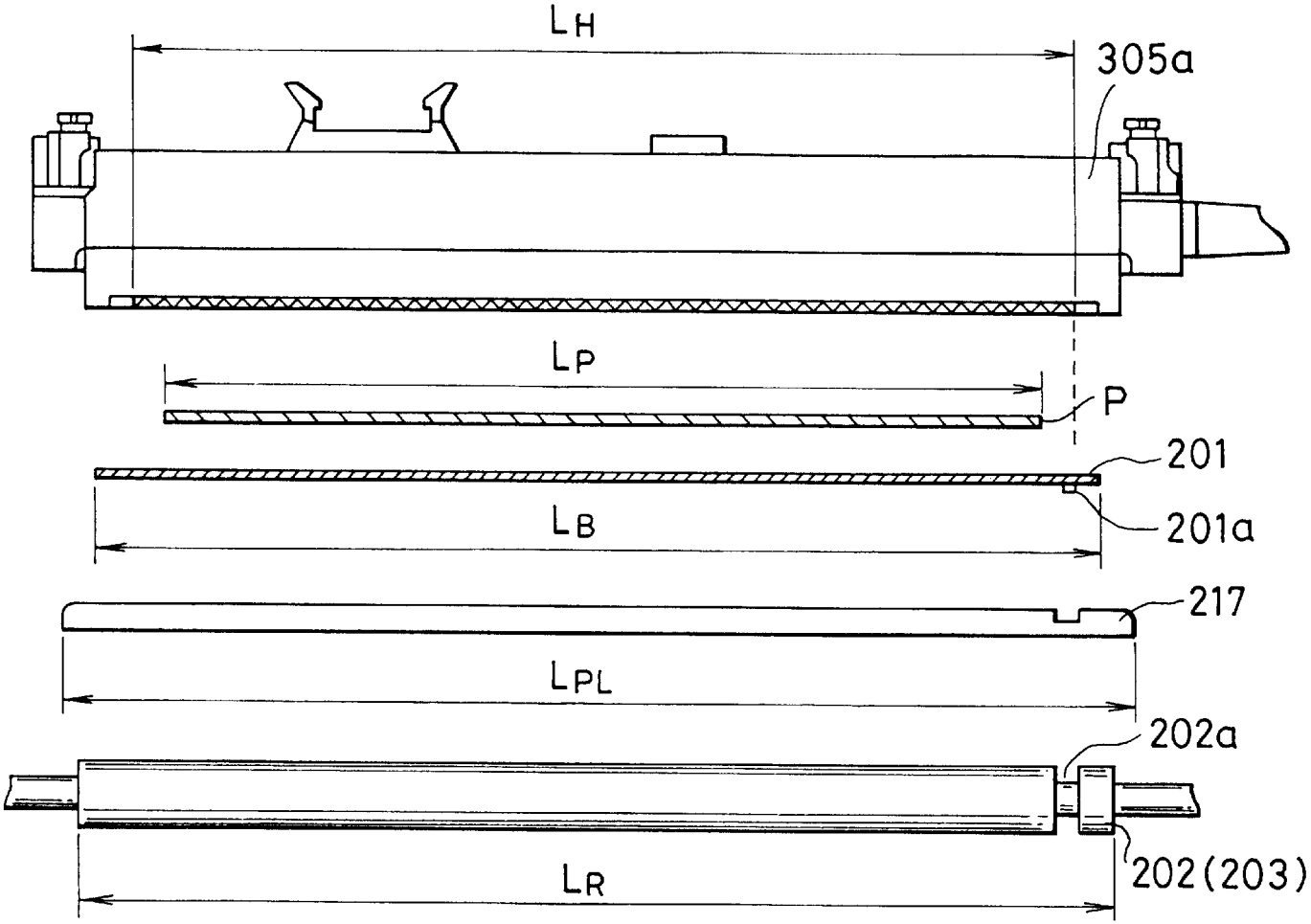
FIG. 6 is a front view of a recording apparatus in accordance with a fourth embodiment of the present invention, particularly illustrating the positional relationship among a recording head, a recording sheet, a conveyance belt, a driving roller, a charging roller and a platen.
Figure 7:
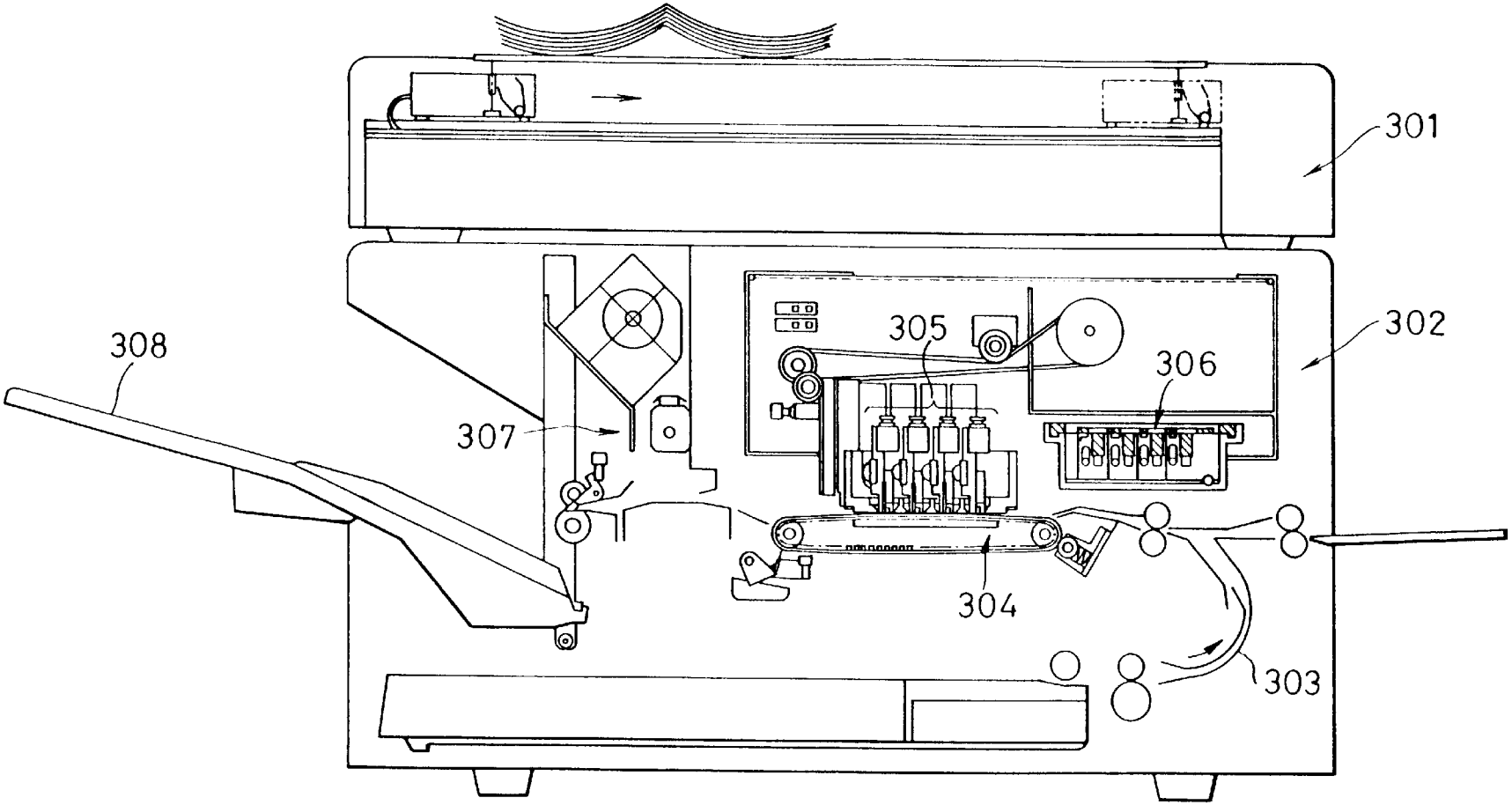
FIG. 7 (PRIOR ART)
FIG. 7 is a schematic side view of a typical conventional recording apparatus.

A fourth embodiment of the present invention will be described below with reference to FIG. 6.

In this embodiment, the recording apparatus is provided with a platen 217 in order to assure that a portion of the conveyance belt 201 located opposite to the recording head 305*a* is held with acceptable flatness. The relationship of a length $L_{PL}$ of the platen 217 relative to width $L_B$ of the conveyance belt 201 is represented by an inequality of $L_{PL} \geqq L_B$. The foregoing relationship is established in consideration of the following status. Specifically, due to the necessity for bringing the platen 217 in close contact with the conveyance belt 201, the former is squeezed against the latter with a certain intensity of pressure. On the other hand, the conveyance belt 201 is caused to move with transverse positional offset unless constant tension is applied to the conveyance belt 201 in the transverse direction. Thus, as long as the relationship represented by the inequality of $L_{PL} \geqq L_B$ is satisfied, no differential tension is caused along the conveyance belt 201 owing to the arrangement of the platen 217. Consequently, it is possible to achieve stable belt conveyance.

While the present invention has been described above with respect to four preferred embodiments thereof, it should of course be understood that the present invention should not be limited only to these embodiments but various changes or modifications may be made without departure from the scope of the present invention as defined by the appended claims.

The present invention achieves a distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated in the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laid-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet recording apparatus for effecting recording on a sheet member, said apparatus comprising:

an ink jet recording head for recording and comprising a predetermined practically available recording width;

an endless conveyance belt, comprising an outer surface for supporting an entire width of the sheet member, for conveying the sheet member to an ink jet recording region, said endless conveyance belt being movable and conveying the sheet member in a longitudinal direction thereof transverse to the width of the sheet member, said endless conveyance belt comprising a projection formed along the longitudinal direction of said belt on an inner surface reverse to the outer surface and located outside of the ink jet recording region; and a roller contacting the inner surface of said endless conveyance belt for displaceably supporting said endless conveyance belt in the longitudinal direction thereof, said roller comprising an annular groove engageable with said projection while contacting the inner surface of said belt, and wherein said projection of said endless conveyance belt engages with said annular groove of said roller so as to prevent said endless conveyance belt from skewing, wherein said endless conveyance belt has a predetermined width $L_B$ for conveying the sheet member, the predetermined practically available recording width of said recording head as measured in a transverse direction of said endless conveyance belt is $L_H$, and a relationship represented by the following inequality is established between the predetermined width $L_B$ and the predetermined width $L_H$, $$L_B > L_H,$$

wherein said recording head is arranged such that said recording head is located inside of said endless conveyance belt with respect to the transverse direction of said endless conveyance belt.

2. An ink jet recording apparatus for effecting recording on a sheet member, said apparatus comprising:

an ink jet recording head for recording and comprising a predetermined practically available recording width;

an endless conveyance belt, comprising an outer surface for supporting an entire width of the sheet member, for conveying the sheet member to an ink jet recording region, said endless conveyance belt being movable and conveying the sheet member in a longitudinal direction thereof transverse to the width of the sheet member, said endless conveyance belt comprising a projection formed along the longitudinal direction of said belt on an inner surface reverse to the outer surface and located outside of the ink jet recording region; and a roller contacting the inner surface of said endless conveyance belt for displaceably supporting said endless conveyance belt in the longitudinal direction thereof, said roller comprising an annular groove engageable with said projection while contacting the inner surface of said belt, and wherein said projection of said endless conveyance belt engages with said annular groove of said roller so as to prevent said endless conveyance belt from skewing, wherein said endless conveyance belt has a predetermined width $L_B$ for conveying the sheet member, the predetermined practically available recording width of said recording head as measured in a transverse direction of said endless conveyance belt is $L_H$, and when the sheet member has a predetermined width $L_P$, a relationship represented by the following inequality is established among the predetermined width $L_B$, the predetermined width $L_P$ and the predetermined width $L_H$, $$L_B > L_H > L_P$$

wherein said endless conveyance belt is arranged such that the sheet member is located inside of said endless conveyance belt with respect to the transverse direction of said endless conveyance belt, and wherein said recording head is arranged such that said recording head is located inside of said endless conveyance belt with respect to the transverse direction of said endless conveyance belt.

3. An ink jet recording apparatus according to claim 2, wherein said roller has a length greater than a width of said endless conveyance belt, said apparatus further comprising belt cleaning means for coming in pressure contact with said roller while said endless conveyance belt is held between said belt cleaning means and said roller in a clamped state, said belt cleaning means having a length greater than the width of said endless conveyance belt.

4. An ink jet recording apparatus according to claim 2, wherein said roller has a length greater than a width of said endless conveyance belt, and the projection is formed around the periphery of said endless conveyance belt.

5. An ink jet recording apparatus according to claim 2, further comprising:

charging roller means for electrically charging said endless conveyance belt when contacting said endless conveyance belt, wherein a relationship represented by the following inequality is established among a width $L_T$ of said charging roller, a width $L_B$ of said endless conveyance belt and a width $L_P$ of the sheet member $$L_B > L_T > L_P.$$

6. An ink jet recording apparatus according to claim 2, further comprising:

a holding member for holding said endless conveyance belt, said holding member being arranged inside of a portion of said conveyance belt located opposite to said recording head, wherein a relationship represented by the following inequality is established between a width $L_{PL}$ of said holding member and a width $L_B$ of said endless conveyance belt $$L_{B \leqq LPL}.$$

7. An ink jet recording apparatus according to claim 2, wherein said recording head comprises an ink jet type recording head from which ink is ejected onto the sheet member, said recording head including an electrothermal energy conversion element for generating thermal energy to be utilized for ejection of the ink, the thermal energy for causing film boiling in the ink.

8. An ink jet recording apparatus according to claim 2, wherein said ink jet recording head comprises an electrothermal energy conversion element for generating thermal energy utilized for ejection of the ink.

9. An ink jet recording apparatus for effecting recording on a sheet member, said apparatus comprising:

an ink jet recording head for recording and comprising a predetermined practically available recording width;

an endless conveyance belt, comprising an outer surface for supporting an entire width of the sheet member, for conveying the sheet member to an ink jet recording region, said endless conveyance belt being movable and conveying the sheet member in a longitudinal direction thereof transverse to the width of the sheet member, said endless conveyance belt comprising a first engaging portion provided along the longitudinal direction of said belt on an inner surface reverse to the outer surface and located outside of the ink jet recording region; and a roller contacting the inner surface of said endless conveyance belt for displaceably supporting said endless conveyance belt in the longitudinal direction thereof, said roller comprising a second engaging portion engageable with said first engaging portion while contacting the inner surface of said belt, and wherein said first engaging portion of said endless conveyance belt engages with said second engaging portion of said roller so as to prevent said endless conveyance belt from skewing, wherein said endless conveyance belt has a predetermined width $L_B$ for conveying the sheet member, the predetermined practically available recording width of said recording head as measured in a traverse direction of said endless conveyance belt is $L_H$, and a relationship represented by the following inequality is established between the predetermined width $L_B$ and the predetermined width $L_H$, $$L_B > L_H,$$

wherein said recording head is arranged such that said recording head is located inside of said endless conveyance belt with respect to the transverse direction of said endless conveyance belt.

10. An ink jet recording apparatus according to claim 9, wherein said ink jet recording head comprises an electrothermal energy conversion element for generating thermal energy utilized for ejection of the ink.

11. An ink jet recording apparatus according to claim 9, wherein said roller has a length greater than a width of said endless conveyance belt, said apparatus further comprising belt cleaning means for coming in pressure contact with said roller while said endless conveyance belt is held between said belt cleaning means and said roller in a clamped state, said belt cleaning means having a length greater than the width of said endless conveyance belt.

12. An ink jet recording apparatus according to claim 9, wherein said roller has a length greater than a width of said endless conveyance belt, and the first engaging portion is formed around the periphery of said endless conveyance belt.

13. An ink jet recording apparatus according to claim 9, further comprising:

a holding member for holding said endless conveyance belt, said holding member being arranged inside of a portion of said conveyance belt located opposite to said recording head, wherein a relationship represented by the following inequality is established between a width $L_{PL}$ of said holding member and a width $L_B$ of said endless conveyance belt $$L_B \leqq L_{PL}.$$

14. An ink jet recording apparatus for effecting recording on a sheet member, said apparatus comprising:

an ink jet recording head for recording and comprising a predetermined practically available recording width;

an endless conveyance belt, comprising an outer surface for supporting an entire width of the sheet member, for conveying the sheet member to an ink jet recording region, said endless conveyance belt being movable and conveying the sheet member in a longitudinal direction thereof transverse to the width of the sheet member, said endless conveyance belt comprising a first engaging portion provided along the longitudinal direction of said belt on an inner surface reverse to the outer surface and located outside of the ink jet recording region; and a roller contacting the inner surface of said endless conveyance belt for displaceably supporting said endless conveyance belt in the longitudinal direction thereof, said roller comprising a second engaging portion engageable with said first engaging portion while contacting the inner surface of said belt, and wherein said first engaging portion of said endless conveyance belt engages with said second engaging portion of said roller so as to prevent said endless conveyance belt from skewing, wherein said endless conveyance belt has a predetermined width $L_B$ for conveying the sheet member, the predetermined practically available recording width of said recording head as measured in a transverse direction of said endless conveyance belt is $L_H$, and when the sheet member has a predetermined width $L_P$, a relationship represented by the following inequality is established among the predetermined width $L_B$, the predetermined width $L_P$ and the predetermined width $L_H$, $$L_B > L_H > L_P,$$

wherein said endless conveyance belt is arranged such that the sheet member is located inside of said endless conveyance belt with respect to the transverse direction of said endless conveyance belt, and wherein said recording head is arranged such that said recording head is located inside of said endless conveyance belt with respect to the transverse direction of said endless conveyance belt.

15. An ink jet recording apparatus according to claim 14, wherein said ink jet recording head comprises an electrothermal energy conversion element for generating thermal energy utilized for ejection of the ink.

16. An ink jet recording apparatus according to claim 14, wherein said roller has a length greater than a width of said endless conveyance belt, said apparatus further comprising belt cleaning means for coming in pressure contact with said roller while said endless conveyance belt is held between said belt cleaning means and said roller in a clamped state, said belt cleaning means having a length greater than the width of said endless conveyance belt.

17. An ink jet recording apparatus according to claim 14, wherein said roller has a length greater than a width of said endless conveyance belt, and the first engaging portion is formed around the periphery of said endless conveyance belt.

18. An ink jet recording apparatus according to claim 14, further comprising:

charging roller means for electrically charging said endless conveyance belt when contacting said endless conveyance belt, wherein a relationship represented by the following inequality is established among a width $L_T$ of said charging roller, a width $L_B$ of said endless conveyance belt and a width $L_P$ of the sheet member $$L_B > L_T > L_P.$$

19. An ink jet recording apparatus according to claim 14, further comprising:

a holding member for holding said endless conveyance belt, said holding member being arranged inside of a portion of said conveyance belt located opposite to said recording head, wherein a relationship represented by the following inequality is established between a width $L_{PL}$ of said holding member and a width $L_B$ of said endless conveyance belt $$L_B \leqq L_{PL}.$$

20. An ink jet recording apparatus for effecting recording on a sheet member, said apparatus comprising:

an ink jet recording head for recording and comprising a predetermined practically available recording width;

an endless conveyance belt, comprising an outer surface for supporting an entire width of the sheet member, for conveying the sheet member to an ink jet recording region, said endless conveyance belt being movable and conveying the sheet member in a longitudinal direction thereof transverse to the width of the sheet member;

a roller contacting the inner surface of said endless conveyance belt for displaceably supporting said endless conveyance belt in the longitudinal direction thereof; and preventing means, disposed between said endless conveyance belt and said roller outside of the ink jet recording region, for preventing said endless conveying belt from skewing, wherein said endless conveyance belt has a predetermined width $L_B$ for conveying the sheet member, the predetermined practically available recording width of said recording held as measured in a traverse direction of said endless conveyance belt is $L_H$, and a relationship represented by the following inequality is established between the predetermined width $L_B$ and the predetermined width $L_H$, $$L_B > L_H,$$

wherein said recording head is arranged such that said recording head is located inside of said endless conveyance belt with respect to the transverse direction of said endless conveyance belt.

21. An ink jet recording apparatus according to claim 20, wherein said ink jet recording head comprises an electrothermal energy conversion element for generating thermal energy utilized for ejection of the ink.

22. An ink jet recording apparatus according to claim 20, wherein said roller has a length greater than a width of said endless conveyance belt, said apparatus further comprising belt cleaning means for coming in pressure contact with said roller while said endless conveyance belt is held between said belt cleaning means and said roller in a clamped state, said belt cleaning means having a length greater than the width of said endless conveyance belt.

23. An ink jet recording apparatus according to claim 20, wherein said roller has a length greater than a width of said endless conveyance belt, and at least a portion of said preventing means is formed around the periphery of said endless conveyance belt.

24. An ink jet recording apparatus according to claim 20, further comprising:

a holding member for holding said endless conveyance belt, said holding member being arranged inside of a portion of said conveyance belt located opposite to said recording head, wherein a relationship represented by the following inequality is established between a width $L_{PL}$ of said holding member and a width $L_B$ of said endless conveyance belt $$L_B \leqq L_{PL}.$$

25. An ink jet recording apparatus for effecting recording on a sheet member, said apparatus comprising:

an ink jet recording head for recording and comprising a predetermined practically available recording width;

an endless conveyance belt, comprising an outer surface for supporting an entire width of the sheet member, for conveying the sheet member to an ink jet recording region, said endless conveyance belt being movable and conveying the sheet member in a longitudinal direction thereof transverse to the width of the sheet member;

a roller contacting the inner surface of said endless conveyance belt for displaceably supporting said endless conveyance belt in the longitudinal direction thereof; and preventing means, disposed between said endless conveyance belt and said roller outside of the ink jet recording region, for preventing said endless conveyance belt from skewing, wherein said endless conveyance belt has a predetermined width $L_B$ for conveying the sheet member, the predetermined practically available recording width of said recording head as measured in a traverse direction of said endless conveyance belt is $L_H$, and when the sheet member has a predetermined width $L_P$, a relationship represented by the following inequality is established between the predetermined width $L_B$, the predetermined width $L_P$ and the predetermined width $L_H$, $$L_B > L_H > L_P,$$

wherein said endless conveyance belt is arranged such that the sheet member is located inside of said endless conveyance belt with respect to the transverse direction of said endless conveyance belt, and wherein said recording head is arranged such that said recording head is located inside of said endless conveyance belt with respect to the transverse direction of said endless conveyance belt.

26. An ink jet recording apparatus according to claim 25, wherein said ink jet recording head comprises an electrothermal energy conversion element for generating thermal energy utilized for ejection of the ink.

27. An ink jet recording apparatus according to claim 25, wherein said roller has a length greater than a width of said endless conveyance belt, said apparatus further comprising belt cleaning means for coming in pressure contact with said roller while said endless conveyance belt is held between said belt cleaning means and said roller in a clamped state, said belt cleaning means having a length greater than the width of said endless conveyance belt.

28. An ink jet recording apparatus according to claim 25, wherein said roller has a length greater than a width of said endless conveyance belt, and at least a portion of said preventing means is formed around the periphery of said endless conveyance belt.

29. An ink jet recording apparatus according to claim 25, further comprising:

charging roller means for electrically charging said endless conveyance belt when contacting said endless conveyance belt, wherein a relationship represented by the following inequality is established among a width $L_T$ of said charging roller, a width $L_B$ of said endless conveyance belt and a width $L_P$ of the sheet member $$L_B > L_T > L_P.$$

30. An ink jet recording apparatus according to claim 25, further comprising:

a holding member for holding said endless conveyance belt, said holding member being arranged inside of a portion of said conveyance belt located opposite to said recording head, wherein a relationship represented by the following inequality is established between a width $L_{PL}$ of said holding member and a width $L_B$ of said endless conveyance belt $$L_B \leq L_{PL}.$$

* * * * *

UNITED STATES PATENT AND TRADEMARK OFFICE

CERTIFICATE OF CORRECTION

PATENT NO. : 6,106,090
DATED : August 22, 2000
INVENTOR(S) : Uchida et al.

It is certified that error appears in the above-identified patent and that said Letters Patent is hereby corrected as shown below:

Before Related U.S. Application Data:
The following should be inserted:
--[*] Notice: This patent issued on a continued prosecution application filed under 37 CFR 1.53(d), and is subject to the twenty year patent term provisions of 35 U.S.C. 154 (a) (2).--.

Column 3:
Line 16, "director" should read --direction--.
Line 64, "arising" should be deleted.

Column 4:
Line 12, "ejected" should read --ejecting--.
Line 28, "length $L_H$;" should read --length $L_H$, --.
Line 29, "$L_B>L_H>L_P$" should read --$L_B>L_H>L_P$,--.

Column 5:
Line 29, "$L_B>L_T>L_P$" should read --$L_B>L_T>L_P$, --.

Column 6:
Line 9, "typical" should read --typical,--.
Line 64, "jointing" should read --joining--.

Column 7:
Line 29, "of" (first occurrence) should read --to--.
Line 35, "portion" should read --portions--.

Column 13:
Line 66, "$L_B>L_H>L_P$" should read --$L_B>L_H>L_P$, --.

UNITED STATES PATENT AND TRADEMARK OFFICE

CERTIFICATE OF CORRECTION

PATENT NO. : 6,106,090
DATED : August 22, 2000
INVENTOR(S) : Uchida et al.

It is certified that error appears in the above-identified patent and that said Letters Patent is hereby corrected as shown below:

Column 14:
Line 42, "$L_B \leq_{LPL}$." should read --$L_B \leq L_{PL}$.--.

Column 15:
Line 16, "traverse" should read --transverse--.

Column 17:
Line 29, "traverse" should read --transverse--.

Column 18:
Line 22, "traverse" should read --transverse--.

Signed and Sealed this

Nineteenth Day of June, 2001

Nicholas P. Godici

*Attest:*

*Attesting Officer*

NICHOLAS P. GODICI
*Acting Director of the United States Patent and Trademark Office*